US007758745B2

(12) United States Patent
Cheng

(10) Patent No.: US 7,758,745 B2
(45) Date of Patent: Jul. 20, 2010

(54) DIESEL DESULFURIZATION METHOD

(76) Inventor: Shun-Sheng Cheng, 625 S. Redwood Rd., Salt Lake City, UT (US) 84104

( * ) Notice: Subject to any disclaimer, the term of this patent is extended or adjusted under 35 U.S.C. 154(b) by 343 days.

(21) Appl. No.: 12/077,643

(22) Filed: Mar. 20, 2008

(65) Prior Publication Data

US 2009/0236266 A1 Sep. 24, 2009

(51) Int. Cl.
*C10G 25/00* (2006.01)
*C10G 17/00* (2006.01)
*C10G 27/00* (2006.01)

(52) U.S. Cl. ..... 208/213; 208/208 R; 208/209; 208/219; 208/221; 208/265; 208/299; 208/189; 208/196

(58) Field of Classification Search ..... 208/208 R
See application file for complete search history.

(56) References Cited

U.S. PATENT DOCUMENTS 5,401,391 A * 3/1995 Collins et al. ..... 208/208 R
6,402,939 B1 * 6/2002 Yen et al. ..... 208/196
7,001,504 B2 * 2/2006 Schoonover ..... 208/208 R
2006/0249429 A1 * 11/2006 Iki et al. ..... 208/209
2008/0173571 A1 * 7/2008 Yen et al. ..... 208/213

OTHER PUBLICATIONS

Zhao, Dlshun et al., Kinetics and Mechanism of Quaternary Ammonium Salts as Phase-Transfer Catalysts in the Liquid-Liquid Phase for Oxidation of Thiophene, Published on Web Aug. 8, 2007, American Chemical Society, Energy & Fuels, 21, 2543-2547.*

* cited by examiner

*Primary Examiner*—Glenn A Caldarola
*Assistant Examiner*—Michelle L Stein
(74) *Attorney, Agent, or Firm*—Clement Cheng

(57) ABSTRACT

A diesel desulfurization method has various steps including: implementing a modified oxidative desulfurization (UAOD) process. The UAOD has the steps of: mixing diesel fuel with room temperature ionic liquid, oxidant, phase transfer catalyst, and acid catalyst in a tank in a mix; recycling the ionic liquid and recycling the acid catalyst in aqueous phase. A step is to move the sulfur from the diesel fuel in a fluidized bed reactor (FBR) having bed reactor material. The process can be improved with ultrasound during mixing, or a high shear mixer. The bed reactor is preferably acidic alumina for adsorbing oxidized sulfur. The oxidant is preferably hydrogen peroxide (H2O2). The acid catalyst is preferably a mixture of Acetic acid and Tri-fluoro acetic acid.

17 Claims, 2 Drawing Sheets

DIESEL DESULFURIZATION METHOD

DISCUSSION OF RELATED ART

Diesel fuel and gasoline are two of the main transportation fuels in use today. Diesel engines typically have great fuel mileage, but diesel fuel is typically derived from crude oil, which often contains sulfur. Therefore, the benefit of high fuel mileage is often offset by increased emissions. Many hybrid cars today running on gasoline can get 50 miles a gallon, comparable to what a diesel car can get. Unfortunately, diesel cars burn diesel fuel that typically produces more emissions. What the world desperately needs today is clean burning diesel to avoid greenhouse gas emissions and to save the environment. Although there have been improvements in diesel engine technology and emissions technology, high sulfur content in diesel still creates pollution.

Of course, it would be great if all the crude oil in the world were sulfur free, but unfortunately that is a fantasy. Thus, industrial processes for removing sulfur are vital for decreasing pollution. The EPA has considered a 15 part per million limit for sulfur in diesel fuel. However, ultra low sulfur diesel (ULSD) fuel production is currently hampered by inefficient desulfurization technology that has not changed much in decades.

Previous methods include Hydrodesulfurization, and Biodesulfurization. Hydrodesulfurization is a common refinery process using a fixed bed reactor. The process typically requires a liquid gas mixture with temperatures ranging from 300 to 400° C. Furthermore, hydrogen gas is required for Hydrodesulfurization. The high temperature and pressure increases costs, land usage and can be explosive. Furthermore, some of the gas and waste heat of the system is lost which creates environmental pollution. Also, the process becomes increasingly inefficient for producing ULSD (15 ppm) fuel since to produce ULSD (15 ppm) fuel instead of LSD (500 ppm) fuel, it requires an additional 25 to 45 percent more hydrogen consumption. Biodesulfurization uses naturally occurring bacteria as biocatalysts. This process typically mixes water and oil with bacteria such as *Rhodococcus* sp. strain IGTS8 in the water. The resultant sulfate salt can be removed since it is water soluble. Unfortunately, Biodesulfurization is a new technology and using bacteria requires sensitive environmental controls, such as reaction temperature, sterilization and solvent tolerance. This has so far made it difficult to implement on a production scale. There is also the S Zorb sulfur removal technology developed by ConocoPhillips. The process uses a proprietary sorbent to adsorb sulfur in a fluidized bed with hydrogen. Other systems such as Transport Reactor for Naphtha Desulfurization (TReND) and Selective Adsorption for Removing Sulfur (SARS) and Oxidative Desulfurization (ODS) have also been used. Each one of these methods has its own advantages and disadvantages, the disadvantages are typically excessive cost and excessive pollution.

Extraction of sulfur from hydrocarbon oil is mentioned in patent literature. For example, U.S. Pat. No. 2,750,252 (the disclosure of which is incorporated herein by reference) teaches using $BF_3$ and Perfluoroalkanoic Acid to extract sulfur from hydrocarbon oil. The method in the '252 patent was patented Jul. 10, 1956.

Therefore it is the singular goal of this invention to decrease pollution via a more efficient and cost effective diesel fuel desulfurization technology.

SUMMARY OF THE INVENTION

To obtain ultra low sulfur diesel less than 15 ppm, the present invention uses modified ultrasound assisted oxidative desulfurization (UAOD) process and fluidized bed reactor (FBR). Ionic liquid, oxidant, phase transfer catalysis, stirring, sonication, and acid catalyst have been combined in the modified UAOD process. With proper oxidant, catalyst, and ionic liquid under the modified UAOD process, three hours is enough to desulfurize 99.9% of various types of model sulfur compounds. Diesel fuels have varying amounts of sulfur. Valley Oil, JP-5, and Treated Valley Oil all have different levels. A 99.9% removal efficiency can be demonstrated by the solvent extraction, as well as, solid adsorption, followed by the modified UAOD process.

The ionic liquid and acid catalyst, can be recycled which is usually contained in the spent aqueous phase. A pilot study used a treatment tank, a pipeline system, and a high shear mixer for the development of a batch-type continuous flow system. FBR passes the oxidized organic compounds from the batch-type continuous flow system. Moreover, acidic alumina adsorbs almost 99.9% of oxidized sulfur. Additionally, recycling does not affect the adsorbent adsorption capacity. Thus, modified UAOD process and FBR can effectively remove sulfur from diesel to produce ULSD fuel by the utilization of appropriate design, as well as, chemicals during the process. Ionic liquid is used at room temperature with solid catalyst polishing.

DETAILED DESCRIPTION OF THE PRESENT INVENTION

Figure 1:
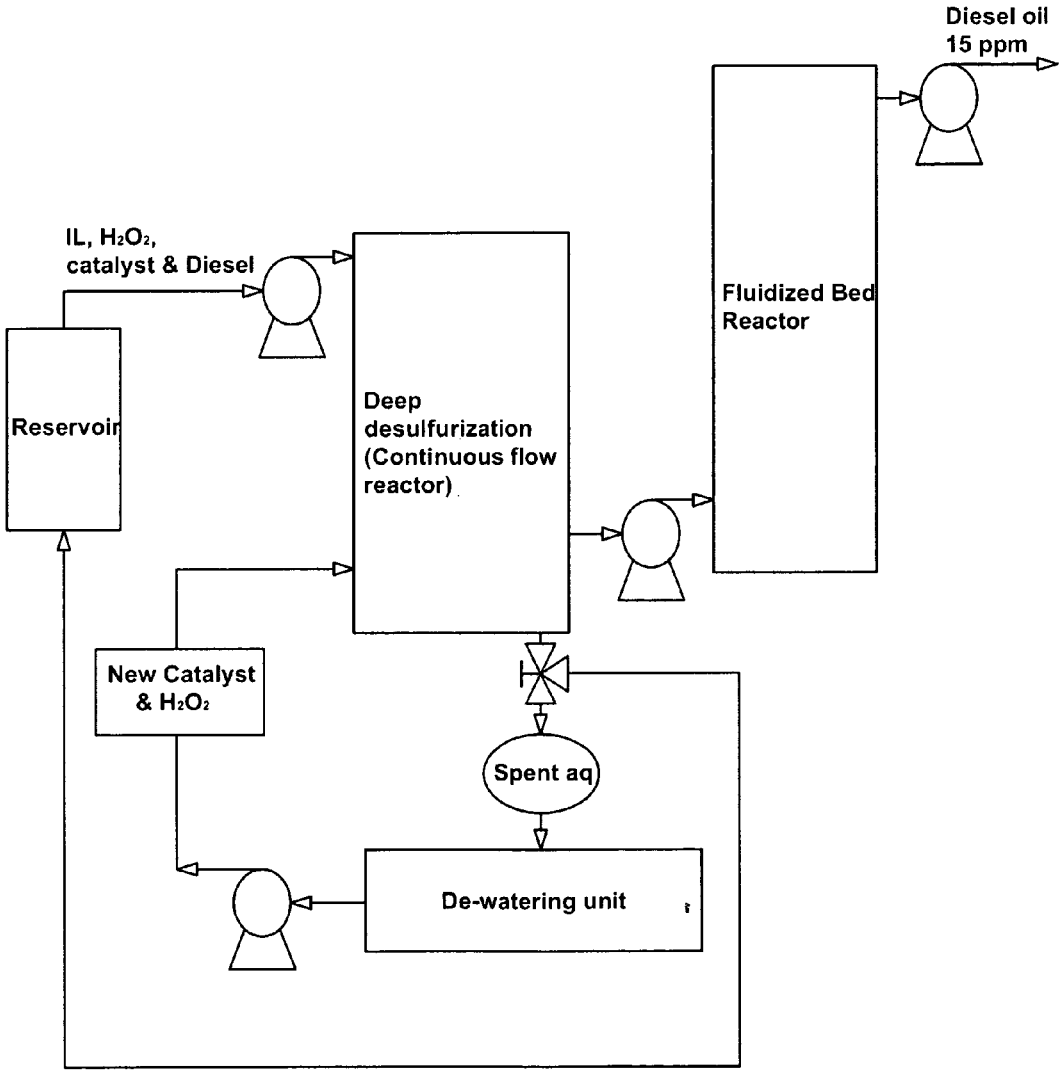
FIG. 1 is a block diagram of a continuous flow system.

The present invention modified desulfurization method includes two parts. The first part involves desulfurization of OSCs with the six complementary techniques: Acid catalyst, phase transfer agent (PTA), oxidant, sonication, mechanical stir and room temperature ionic liquids (RTILs). In the second part, desulfurization of thiophene occurs via solid catalyst with microporous crystalline titanium silicates.

The key part of this system is to use acid catalyst, phase transfer agent (PTA), oxidant, sonication, mechanical stir and room temperature ionic liquids (RTILs) simultaneously.

There are hundreds of different catalysts and all of them have different properties. Acetic acid is a good catalyst. Trifluoro acetic acid is also a good catalyst. The best mode is to have 20% Tri-fluoro acetic acid with 80% Acetic acid, hereafter called 20% Tri-fluoro acetic acid. Tri-fluoro acetic acid concentration can vary from 15% to 40%.

The phase transfer agent can be Tetraoctylammonium fluoride.

Picking the right oxidant is also very important. The most common oxidants include hypohalite compounds, chlorite, permanganate salts, ammonium cerium (IV) nitrate, hexavalent chromium compounds, peroxide compounds, Tollen's Reagent, sulfoxides, persulfuric acid, oxygen and ozone. These oxidants enable donate oxygen atoms to the sulfur in mercaptans (thiols), sulfides, disulfides and thiophenes to form sulfoxides or sulfones. Each of these have different active oxygen percentages and different byproducts produced. The best mode for this particular system and method is hydrogen peroxide. Hydrogen peroxide comes in a variety of concentrations. It can be very dilute at about 10% and the best mode is 30% hydrogen peroxide in water.

Ultrasound coinciding with mechanical stirring when done simultaneously improves reaction desulfurization efficiency up to 89.3% in laboratory tests. The reaction is also faster. In a typical reaction, with only stirring a batch that would take six hours should only take three hours with simultaneous sonication and stirring. The best mode is to have an ultrasound time also called sonication time of approximately 10 minutes with a stir time of about 170 minutes or about three hours.

The next step in setting up the refinery process is to select an appropriate room temperature ionic liquid. This would be typically a nitrogen containing organic cation and inorganic anion, and the salts have melting temperature lower than room temperature making it a room temperature ionic liquid. Lewis acidic AlCl3-TMAC, [EMIM][BF4], [BMIM][BF6], [BMIM][PF4] and Trimethylammonium chloroaluminate (AlCl3-TMAC) are all acceptable for the process. For large scale production, halogen-free [BMIM][OcSO4] and [EMIM][EtSO4] are available.

To summarize the best mode of the first step, take diesel fuel having sulfur and send it to a fluidized bed reactor with 20% Tri-fluoro acetic acid catalyst, hydrogen peroxide oxidant, and room temperature ionic liquid. Then apply ultrasound for about 10 minutes while mechanically stirring for about 170 minutes or about three hours. In an experimental study for the reactivity of OSCs for this particular method using RTILs and UAOD, with model sulfur compounds, namely T, 2MT, 2ET, BT, 2 MBT. DBT and 4,6-DMDBT, the following table shows an efficient protocol condition test for a batch.

TABLE 1

Efficient protocol condition of UAOD on model sulfur compounds

| | |
|---|---|
| OSCs/toluene solution | 5 gram |
| 30% H2O2 | 5 gram |
| 20% TFA | 1.5 gram |
| TAOF | 0.3 gram |
| [EMIM][EtSO4] | 5 gram |
| Reaction temperature | About 50° C. |
| UAOD time | 10 min |
| Stir time | 170 min |

TABLE 2

Summery of model sulfur compound under optimized condition

| Model Compound | Initial conc. (ppm) | Final conc. (ppm) | Desulfurization (%) |
|---|---|---|---|
| T | 524 | 88 | 89.5 |
| 2MT | 500 | 79 | 84.2 |
| 2ET | 500 | 67 | 86.6 |
| BT | 500 | 298 | 40.4 |
| 2MBT | 518 | 318 | 38.6 |
| DBT | 512 | 7 | 98.6 |
| 4,6-DMDBT | 521 | 17 | 96.0 |

The second step is desulfurization of thiophene via solid catalyst with microporous crystalline titanium silicates. The two steps should take out 99.9% of the sulfur in diesel fuel.

The Ti—B Solid Catalyst can be synthesized or purchased from a dealer. The following instructions describe how to make a small batch from scratch. For solution A, 0.58 gram of TBOT is first added to 4 grams of deionzed water and mixed for 1 hour. Next, add 2 grams of H2O2 to the mixture. The mixture is stirred at room temperature for 1 hour, to form a solution containing peroxide titanate. For solution B, 0.0124 gram of anhydrous NaAlO2 and 0.015 gram of NaOH are dissolved in 8 g of TEAOH at room temperature and stirred for 1 hour. Solution B is added to solution A and stirred for 1.5 hours. A homogenous solution appears after 2 hours and is heated to 353K and dried while stirring. When the gel is completely dry, it is ground into fine powder. The fine powder is transferred into a Teflon beaker situated in a Teflon inner of an autoclave, and 5 gram of water is added to the bottom of autoclave. This is the source of steam (VPT). The crystallization is carried out in steam first at 403K for 96 hours, and 448K for 18 hours. The product is washed with distilled water, dried at 308K for 10 hours and calcined at 793K for 10 hours in the flow of air. The Ti-Beta product is treated with 1M H2SO4 at room temperature for 12 hours and then washed with distilled water, dried at 308K for 10 hours, and calcined at 793K for 5 hours in the flow of air.

A fluidized bed reactor is set up which typically comprises a packed bed and a stirred tank with substrate entering at the bottom of the tank and removing product from the top of the tank. The packed bed increases surface area contact between two phases such as oxidized organic sulfur and adsorbent. Fluidized bed reactors are extensively employed in stirring hard elements with gases or liquids. In many manufacturing applications, a fluidized bed comprises an upright oriented column full of granular matter and a fluid such as a gas or liquid that is pushed up through a dispenser at the floor of the bed. When the total energy of running fluid surpasses gravity, particles are raised and fluidization takes place.

A third step in this system is to recycle the catalyst and room temperature ionic liquid. To recycle the alumina, the saturated alumina is claimed with furnace and the starting oven temperature is 200° C. for 30 minutes to evaporate the aqueous solution. Then, it increase 25° C. each 10 minutes, until the temperature reached is 500° C. which is held for 6 hours.

Additional Test Results

For medium sulfur diesel fuel the following procedure is suggested. Tetraoctylammonium fluoride and also acetonitrile (CH3CN), can be used as phase transfer agent (PTA). Preferably, approximately 0.3 g of acetonitrile are used for every 5 g of diesel fuel. Acetic acid and tri-fluoro acetic acid (TFA) with glacial grade are used as catalyst. 30% hydrogen peroxide (H2O2) is used as oxidant. 1-butyl-3-methylimidazolium hexafluorophosphate [BMIM][PF6], 1-butyl-3-methylimidazolium octyl sulfate [BMIM][OcSO4] and 1-ethyl-3-methylimidazolium ethyl sulfate [EMIM][EtSO4] is used as ionic liquid. A variety of sulfur concentration analyzers are commercially available and can be used to verify desulfurization efficiencies. Gas chromatography can also be helpful. In laboratory tests, [EMIM][EtSO4] ionic liquid and hydrogen peroxide were contained in the aqueous phase that was extracted from 85% of the total organic sulfur compounds. This resulted in the reduction that was observed to be reduced from 560 ppm to 84 ppm, which is a huge amount of reduction.

Theoretically almost all of the oxidized sulfur could be partitioned into the ionic phase, however this could require a long stir time for example such as about 20 hours. The acetonitrile (CH3CN) provides a 1:5 ratio of extraction weight.

On high sulfur diesel fuel of about 8000 ppm, the aromatic skeletons are different. Basically, the sulfur molecules are bigger. In this situation, it is better to increase the stirring time to six hours. The following table illustrates the desulfurization efficiency as laboratory tested

TABLE 3

Effect of RTILs on desulfurization efficiency on Valley Oil (one time treatment) using a variety of ionic liquid

| Ionic liquid | Stir 6 hours (ppm) | Desulfurization (%) | UAOD (ppm) | Desulfurization (%) |
|---|---|---|---|---|
| [BMIM][PF6] | 5,715 | 29.4 | 4,012 | 50.5 |
| [EMIM][EtSO4] | 3,883 | 52.1 | 2,400 | 70.4 |
| [BMIM][OcSO4] | 6,288 | 22.4 | 4,622 | 42.9 |

The process when run a third time produces a 6 ppm which is enough to meet the EPA regulations. Using sulfate anion based ILs, all kind of diesel fuels can achieve more than 99.9% of sulfur reduction. Again, [EMIM][EtSO4] IL shows slight better desulfurization efficiency.

| | Initial conc. (ppm) | Final conc. (ppm) | Desulfurization (%) |
|---|---|---|---|
| Valley Oil RTIL | | | |
| [EMIM][$EtSO_4$] | 8,100 | 6 | >99.9 |
| [EDMIM][$EtSO_4$] | 8,100 | 8 | >99.9 |
| [$TBMNH_4$][$MeSO_4$] | 8,100 | 11 | >99.8 |
| [TBMP][$MeSO_4$] | 8,100 | 9 | >99.9 |
| F-76 RTIL | | | |
| [EMIM][$EtSO_4$] | 4,220 | 2 | >99.9 |
| [EDMIM][$EtSO_4$] | 4,220 | 5 | >99.9 |
| [$TBMNH_4$][$MeSO_4$] | 4,220 | 5 | >99.9 |
| [TBMP][$MeSO_4$] | 4,220 | 8 | >99.8 |
| JP-5 RTIL | | | |
| [EMIM][$EtSO_4$] | 740 | 0 | 100 |
| [EDMIM][$EtSO_4$] | 740 | 4 | >99.4 |
| [$TBMNH_4$][$MeSO_4$] | 740 | 3 | >99.4 |
| [TBMP][$MeSO_4$] | 740 | 2 | >99.4 |

In the entire process, oxidation of organic sulfur compounds was carried out in the presence of ultrasound, excess H2O2, RTILs, acid catalyst, and PTA. Recovering the catalyst and RTIL is critical. RTIL is expensive and must be conserved. Test results show that spent catalyst and RTIL can be recycled at least three times without any problems with desulfurization efficiency.

The following table shows the test results

TABLE 5

Spent catalyst & RTIL reused in new desulfurization process with Treated valley Oil

| | Initial conc. (ppm) | Final conc. (ppm) | Desul-furization (%) | Solvent Extraction (ppm) | Desul-furization (%) |
|---|---|---|---|---|---|
| [EMIM][$EtSO_4$] (New) | 560 | 84 | 80.5 | <1 | 99.9 |
| [EMIM][$EtSO_4$] (Spent 1$^{st}$ time) | 560 | 141 | 74.8 | <1 | 99.9 |
| [EMIM][$EtSO_4$] (Spent 2$^{nd}$ time) | 560 | 182 | 67.5 | <1 | 99.9 |
| [EMIM][$EtSO_4$] (Spent 3$^{rd}$ time) | 560 | 265 | 52.7 | 9 | 98.4 |

TABLE 6

Spent catalyst & RTIL reused in modified UAOD process with Valley Oil

| | Initial conc. (ppm) | Final conc. (ppm) | Desul-furization (%) | Solvent Extraction (ppm) | Desul-furization (%) |
|---|---|---|---|---|---|
| [EMIM][$EtSO_4$] (New) | 8,100 | 84 | 80.5 | <1 | 99.9 |
| [EMIM][$EtSO_4$] (Spent 1$^{st}$ time) | 8,100 | 141 | 74.8 | <1 | 99.9 |
| [EMIM][$EtSO_4$] (Spent 2$^{nd}$ time) | 8,100 | 182 | 67.5 | <1 | 99.9 |
| [EMIM][$EtSO_4$] (Spent 3$^{rd}$ time) | 8,100 | 265 | 52.7 | 9 | 98.4 |

To conclude, the present invention modified UAOD process for desulfurization of commercial diesel fuels has three steps: Stirring, UAOD and solvent extraction. The desulfurization efficiency was also enhanced with the application of RTILs, PTA and acid catalyst.

The following table is the best mode for practicing the invention

TABLE 7

Efficient protocol condition of desulfurization on diesel fuels

| | | |
|---|---|---|
| Diesel sample | 5 | gram |
| 30% $H_2O_2$ | 5 | gram |
| 20%TFA | 1.5 | gram |
| TAOF & $CH_3CN$ | 0.3 | gram |
| [EMIM][$EtSO_4$] | 5 | gram |
| Reaction temperature | 50° | C. |
| UAOD time | 10 | min |
| Stir time | 170 or 350 | min |

The following table illustrates the desulfurization efficiency as tested.

TABLE 8

Desulfurization efficiency of Modified UAOD process on diesel fuels

| Diesel Fuels | Sulfur Content (ppm) Original | After Oxidation | After Extraction | Sulfur Removal (%) |
|---|---|---|---|---|
| JP-5 | 740 | 120 | <1 | 99.9 |
| Treated Valley Oil | 560 | 84 | <1 | 99.9 |
| F-76 | 4,220 | 1,657 | <1 | 99.9 |
| Valley Oil | 8,110 | 2,400 (1$^{st}$)/ 1,372 (2$^{nd}$) | 6 | 99.9 |

Continuous Flow System

A continuous flow system can be set up so that discrete batches are not required. A test continuous flow system was set up with Tetraoctylammonium fluoride used as phase transfer agent (PTA) was synthesis from (Dermeik, et al. 1989). Acetic acid, tri-fluoro acetic acid (TFA) as catalyst, 1-ethyl-3-methylimidazolium ethyl sulfate [EMIM][EtSO4] as ionic liquid and aluminum oxide (activated, acidic, Brokmann I, standard grade, ~150 mesh, 58A) as adsorption media were obtained from Aldrich Chemical. 30% hydrogen peroxide (H2O2) as oxidant and acetonitrile as extraction solvent were obtained from VWR Inc.

A high shear mixer is used that generates a high blend of both automatic and cavitation shear. A high shear mixer at 5,000 rpm may replace the ultrasonic component.

FIG. 1 is a block diagram of a continuous flow system. In the continuous flow system, the reservoir of ionic liquid, hydrogen peroxide, catalyst and diesel is pumped into the deep desulfurization continuous flow reactor. Spent aqueous catalyst is pumped to a dewatering tank for recycling. New catalyst and hydrogen peroxide is then continuously reintroduced into the deep desulfurization continuous flow reactor. Product from the continuous flow reactor is sent to the fluidized bed reactor, for removal of sulfur, thereby producing diesel oil at 15 ppm or less.

Having more acid catalyst will improve the reaction rate. More acetic acid, 20% tri-fluoro acetic acid (TFA) can be used which will improve the reaction rate. Also, the concentration of 20% tri-fluoro acetic acid (TFA) can be increased to 40% tri-fluoro acetic acid (TFA) which will also improve desulfurization reaction rate.

More ionic liquid can be added to improve the reaction rate further,

For a 20,000 gallon per day ultralow sulfur diesel with an initial sulfur concentration of about 8000 ppm, the volume of the batch type continuous flow reactor would have to be about 10 $m^3$ or about 2000-3000 gallons. 20,000 gallons is approximately 2 tanker trucks of fuel.

Figure 2:
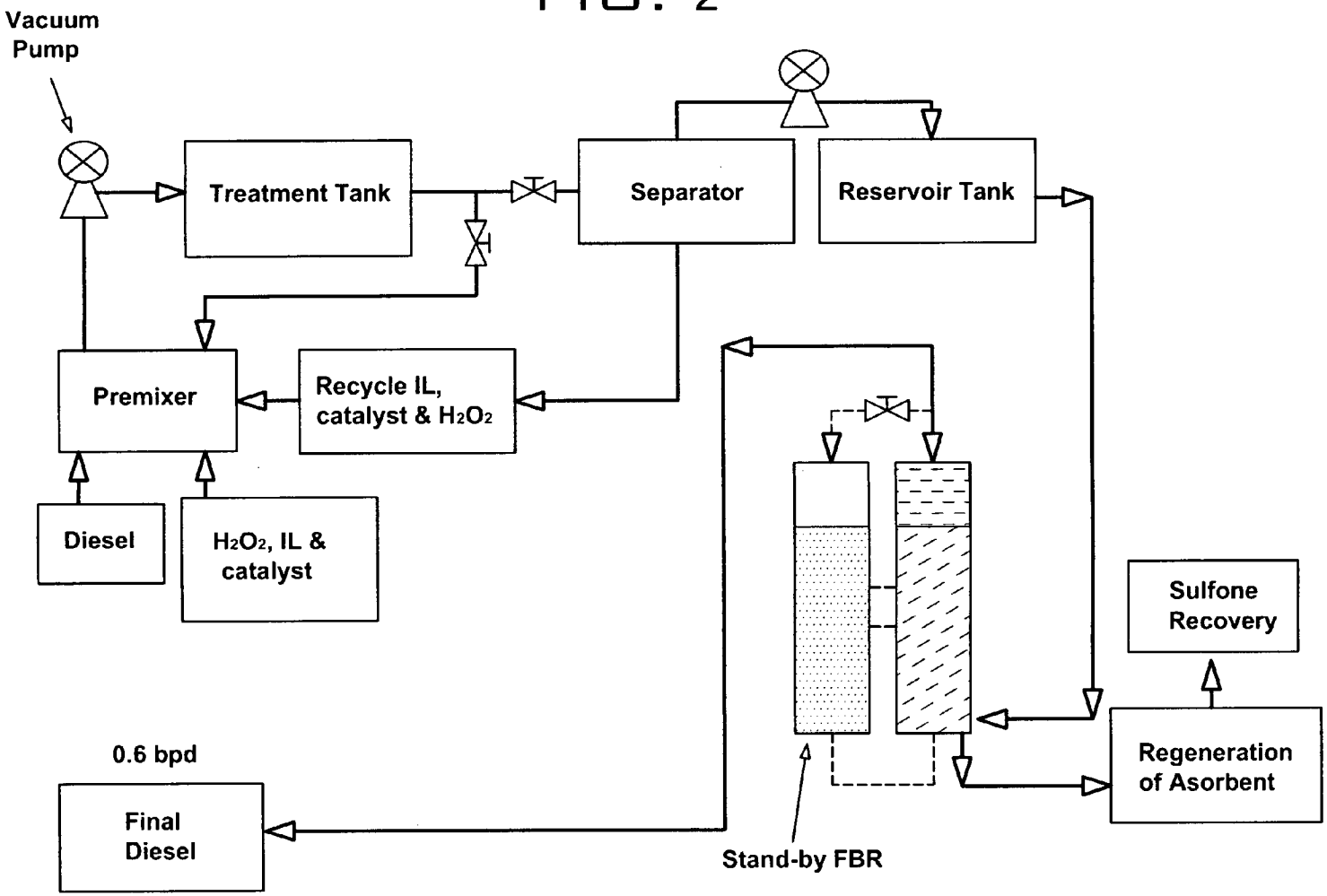
FIG. 2 is a block diagram showing continuous modified UAOD process.

FIG. 2 is a block diagram showing continuous modified UAOD process with a diesel fuel input into a pre-mixer. Also, hydrogen peroxide, catalyst and ionic liquid is also introduced into the pre-mixer. After the pre-mixer remixes the blend of ingredients, the vacuum pump pumps the mixture to a treatment tank. The treatment tank sends a portion back to the pre-mixer and a portion to the separator. The separator separates the ionic liquid, catalyst and hydrogen peroxide for recycling back into the pre-mixer. The separator sends letter elements to the reservoir tank. The reservoir tank then sends its product to the FBR. The FBR absorbent can be recovered and regenerated. After passing through the FBR, the final diesel is output.

FIG. 2 has been used for the illustration of a schematic flow diagram of continuous modified UAOD process on diesel fuels with 0.6 bpd production rate that as been development. Specifically, two stage operations have been consisted in the system. Firstly, IL, H2O2, and acid catalyst are utilized in the modified UAOD process with catalytic oxidation of sulfur. Secondly, adsorption of oxidized sulfur compound from diesel fuels was allowed by the alumina that was packed in the Fluidized bed reactor (FBR). It was indicated by the results that consideration of multistage treatment tanks in series should be done for the achievement of higher daily production rate.

After the treatment tank, employment of separator is done for the purpose of phase separation, FBR achieves the diesel phase after its transformation, and feed stream is introduced with spent aqueous phase for its reutilization. For adsorption, alumina adsorbs the oxidized sulfur compounds, and the diesel fuels are separated from these compounds after their removal. During this process, chemical or thermal conversion of sulfone by-products is done, which results in the formation of sulfonate, and sometimes, hydrocarbons that are contained in a sulfone converter.

When implementing continuous flow, the Modified UAOD process combines complementary techniques: acid catalyst, phase transfer catalysis, mixing, IL and oxidant. The oxidation of model sulfur compounds can be carried out in ultrasound and stir mixing with excess of H2O2 as oxidant, and acid catalyst (acetic acid and tri-fluoro acetic acid) utilized as a catalyst. IL and quaternary ammonium salts (QAS) operate as phase transfer agents during the oxidation process. Phase transfer agent (PTA) including QAS and IL, both PTA can reduce the surface tension between the two phases. QAS in modified UAOD process is desirable to be used at low dosage to permit high reaction rate and to prevent side effects such as foaming.

"Sulfur" free diesel can be used as the solvent under the modified UAOD process. The minimum amount of time under the process appears to be three hours. Oxidation of organic sulfur compounds are carried out in the presence of ultrasound, H2O2, RTILs, acid catalyst, and PTA. The oxidation process of organic sulfur compounds to its corresponding sulfones can be allowed by the excess amount of acid catalyst, PTA, and H2O2 in the spent aqueous phase.

A significant role has been played by the hydrogen peroxide (H2O2), as the towering desulfurization competence would be carried out by 3% H2O2. However, achievement of 15 ppm desulfurization can be attained after more time elapse. 30% H2O2 is preferred but 20% and 40% is also acceptable.

A number of processes are thought to occur during the modified UAOD process which consists of 7 steps: (1) Acid catalyst is peroxidized with oxidant and forming per-acetic anion and per-tri fluoro acetic anion. (2) Formation of ion pair between quaternary ammonium salts and peroxidized acid catalyst. (3) Ion pair transfer from aqueous phase into organic phase. (4) Organic sulfur compounds are oxidized into its corresponding sulfone. (5) IL is peroxidized with oxidant and forming alkyl per-sulfate anion. (6) Alkyl per-sulfate anion transfer from aqueous phase into organic phase that allow organic sulfur compound to be oxidized. (7) Well mixing enhances the mass transfer of the oxidation reaction.

Mixing plays a very important parameter in the modified UAOD process. Ultrasound, magnetic stir, and several other mixing strategies work well. Specifically, 5,000 rpm with the 50° C. of reaction temperature was observed during the process with high shear mixer.

It has been observed that weight ratio of IL does not affect the desulfurization efficiency, as it has been with the ratio of 1:1 in batch study, as well as, 1:100 with the IL in pilot study. In other words, system only required small amount of IL. Thus, transfer of oxidant from aqueous phase can be done with high affinity of IL into the organic phase.

In the pilot study, 20% TFA is not sufficient to desulfurize high sulfur content diesel fuel (Valley Oil), therefore, 40% TFA has been used for new catalyst concentration. Although, 1/10 of catalyst usage has been used in pilot study compare to batch study, and still achieve high desulfurization efficiency.

Removal of oxidized sulfur is usually done by the fluidized bed reactor. In addition, 11.8 mg S/g alumina and 13.8 mg S/g alumina has shown similar adsorption capacity during the study of diesel fuels, such as F-76 and Valley Oil. Although, similar results were shown by the fluidized bed reactor regarding the adsorption capacity, as compared to the packed column study. However, higher adsorption capacity was one of the advantages that have been provided by the fluidized bed reactor. In addition, adsorption ability of this reactor cannot be weakened by its recycling.

The invention claimed is:

1. A diesel desulfurization method comprising the steps of:

a. implementing a modified oxidative desulfurization (UAOD) process comprising the steps of: mixing diesel fuel with room temperature ionic liquid, oxidant, phase transfer catalyst, and acid catalyst in a tank in a mix;

b. recycling the ionic liquid and recycling the acid catalyst in aqueous phase;

c. removing the sulfur from the diesel fuel in a fluidized bed reactor (FBR) having bed reactor material; wherein the ionic liquid is 1-butyl-3-methylimidazolium hexafluorophosphate [BMIM][PF6], 1-butyl-3-methylimidazolium octyl sulfate [BMIM][OcSO4] and 1-ethyl-3-methylimidazolium ethyl sulfate [EMIM][EtSO4].

2. The diesel desulfurization method of claim 1, further comprising the step of using ultrasound while mixing.

3. The diesel desulfurization method of claim 2, further comprising the step of using ultrasound while mixing to expose the mix to at least 10 minutes of sonication.

4. The diesel desulfurization method of claim 1, wherein the mixing is done with a high shear mixer.

5. The diesel desulfurization method of claim 1, wherein the bed reactor material is acidic alumina for adsorbing oxidized sulfur.

6. The diesel desulfurization method of claim 1, wherein the oxidant is hydrogen peroxide (H2O2).

7. The diesel desulfurization method of claim 1, wherein the acid catalyst is Acetic acid and Tri-fluoro acetic acid.

8. The diesel desulfurization method of claim 1, wherein the acid catalyst is between 15% Tri-fluoro acetic acid with 85% Acetic acid and 40% Tri-fluoro acetic acid with 60% Acetic acid.

9. The diesel desulfurization method of claim 1, wherein the phase transfer agent is Tetraoctylammonium fluoride.

10. The diesel desulfurization method of claim 1, further comprising use of a solid catalyst which is Ti—B Solid Catalyst.

11. The diesel desulfurization method of claim 1, further comprising the step of using acetonitrile as a second phase transfer agent.

12. A diesel desulfurization method comprising the steps of:

a. implementing a modified oxidative desulfurization (UAOD) process comprising the steps of: mixing diesel fuel with room temperature ionic liquid, oxidant, phase transfer catalyst, and acid catalyst in a tank in a mix; wherein the oxidant is hydrogen peroxide (H2O2);

b. recycling the ionic liquid and recycling the acid catalyst in aqueous phase;

c. removing the sulfur from the diesel fuel in a fluidized bed reactor (FBR) having bed reactor material wherein the bed reactor material is acidic alumina for adsorbing oxidized sulfur; wherein the ionic liquid is 1-butyl-3-methylimidazolium hexafluorophosphate [BMIM][PF6], 1-butyl-3-methylimidazolium octyl sulfate [BMIM][OcSO4] and 1-ethyl-3-methylimidazolium ethyl sulfate [EMIM][EtSO4].

13. The diesel desulfurization method of claim 12, further comprising the step of using ultrasound while mixing.

14. The diesel desulfurization method of claim 12, wherein the acid catalyst is between 15% Tri-fluoro acetic acid with 85% Acetic acid and 40% Tri-fluoro acetic acid with 60% Acetic acid.

15. The diesel desulfurization method of claim 12, wherein the phase transfer agent is Tetraoctylammonium fluoride.

16. The diesel desulfurization method of claim 12, further comprising use of a solid catalyst which is Ti—B Solid Catalyst.

17. The diesel desulfurization method of claim 12, further comprising the step of using acetonitrile as a second phase transfer agent.

* * * * *